US009896235B2

(12) United States Patent
Rajter, Jr.

(10) Patent No.: US 9,896,235 B2
(45) Date of Patent: Feb. 20, 2018

(54) BOX LID

(71) Applicant: Wynalda Litho, Inc., Belmont, MI (US)

(72) Inventor: Robert G. Rajter, Jr., Rockford, MI (US)

(73) Assignee: Wynalda Litho, Inc., Belmont, MI (US)

( * ) Notice: Subject to any disclaimer, the term of this patent is extended or adjusted under 35 U.S.C. 154(b) by 0 days.

(21) Appl. No.: 15/175,669

(22) Filed: Jun. 7, 2016

(65) Prior Publication Data

US 2016/0362219 A1 Dec. 15, 2016

Related U.S. Application Data

(60) Provisional application No. 62/173,821, filed on Jun. 10, 2015.

(51) Int. Cl.
*B65D 5/42* (2006.01)
*B65D 5/64* (2006.01)
*B65D 5/68* (2006.01)

(52) U.S. Cl.
CPC ..... *B65D 5/422* (2013.01); *B65D 5/64* (2013.01); *B65D 5/68* (2013.01)

(58) Field of Classification Search
CPC ..... B65D 5/422; B65D 5/64; B65D 5/667; B65D 5/4229; B65D 5/4216; B65D 85/187; B65D 5/685
USPC ..... 229/116.1; 206/268, 831, 459.5
See application file for complete search history.

(56) References Cited

U.S. PATENT DOCUMENTS 502,952 A * 8/1893 Craw ..... B65D 5/68 229/125.19
6,027,018 A * 2/2000 Yocum ..... B65D 5/422 206/459.5
6,109,514 A * 8/2000 Otis ..... B65D 5/4225 206/459.5
9,174,761 B1 * 11/2015 Grist ..... B65D 5/563
2002/0134824 A1 * 9/2002 Mills ..... B65D 5/2076 229/122
2005/0218202 A1 * 10/2005 Braoudakis ..... B65D 5/22 229/178
2006/0000737 A1 * 1/2006 Vogel ..... A47F 3/142 206/459.5
2012/0074823 A1 * 3/2012 Bezich ..... A47B 87/0292 312/240

* cited by examiner

*Primary Examiner* — Christopher Demeree
(74) *Attorney, Agent, or Firm* — Zollinger & Burleson Ltd.

(57) ABSTRACT

A foldable lid for a box-type container includes a promotional panel that has a printable surface disposed on the same side of the blank used to create the lid as the other printing surfaces of the lid. When the blank is printed, material can be added to the promotional panel at the same time and with the same equipment as the other surfaces of the lid. When the lid is assembled, the promotional panel is disposed on the inside of the main body panel of the lid facing the cavity of the container. When the user removes the lid, the promotional panel can be viewed.

22 Claims, 2 Drawing Sheets

BOX LID

CROSS REFERENCE TO RELATED APPLICATIONS

This application claims the benefit of U.S. Provisional Patent Application Ser. No. 62/173,821 filed Jun. 10, 2015; the disclosures of which are incorporated herein by reference.

BACKGROUND OF THE DISCLOSURE

1. Technical Field

The disclosure generally relates to packaging for merchandise and, more particularly, packaging formed from foldable materials with a printable surface. Specifically, the disclosure relates to a five-sided device used for packaging or as a portion of merchandise packaging wherein the interior of the major body panel includes an interior panel that has a printable surface that faces the same direction as the other printable surfaces prior to erection so that the entire device can be printed on one side of the blank.

2. Background Information

Shoe manufacturers seek unique packaging alternatives to the standard folded shoebox. One option is to provide printing on the inside surfaces of the shoebox. The printing can be information about the company that manufactured the shoes or it can be a motivational message. Adding such printing to the inside of the box increases printing costs because the printed material is typically added to both sides of the foldable material in order for the printing to appear of the inside of the box. This requires a printer that can print on both sides of the material or a second pass through a printer.

SUMMARY OF THE DISCLOSURE

The disclosure provides a foldable lid for a box-type container wherein the lid includes a promotional panel that has a printable surface disposed on the same side of the blank used to create the lid as the other printing surfaces of the lid. When the blank is printed, material can be added to the promotional panel at the same time and with the same equipment as the other surfaces of the lid. When the lid is assembled, the promotional panel is disposed on the inside of the main body panel of the lid facing the cavity of the container. When the user removes the lid, the promotional panel can be viewed.

The disclosure also provides a lid for a shoebox type container that has an extra lid panel that provides a finished appearance to the lid and strengthens the lid.

The preceding non-limiting aspects, as well as others, are more particularly described below. A more complete understanding of the processes and equipment can be obtained by reference to the accompanying drawings, which are not intended to indicate relative size and dimensions of the assemblies or components thereof. In those drawings and the description below, like numeric designations refer to components of like function. Specific terms used in that description are intended to refer only to the particular structure of the embodiments selected for illustration in the drawings, and are not intended to define or limit the scope of the disclosure.

BRIEF DESCRIPTION OF THE DRAWINGS

Similar numbers refer to similar parts throughout the specification.

DETAILED DESCRIPTION OF THE DISCLOSURE

Figure 1:
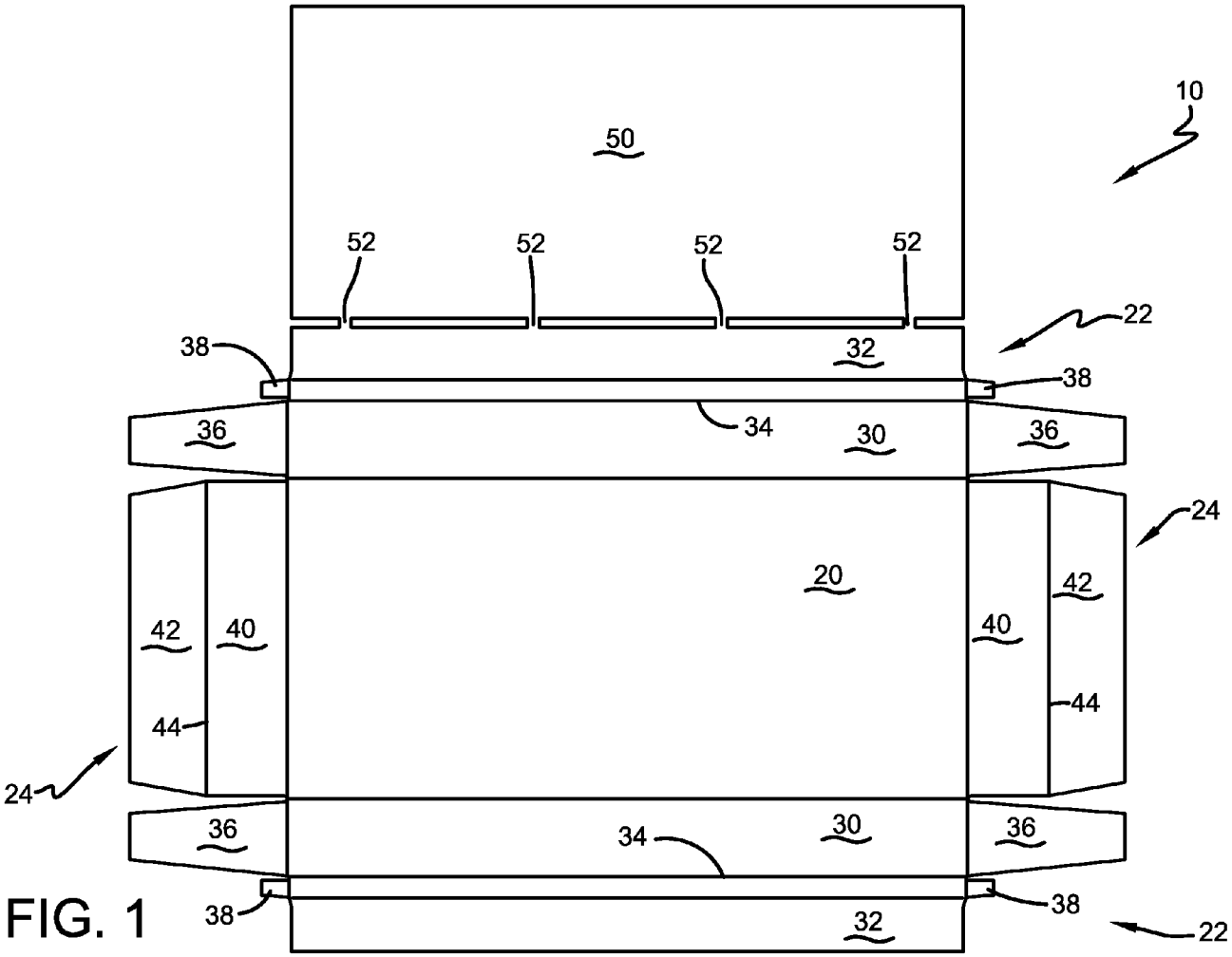
FIG. 1 is a plan view of a blank used to for the lid of the disclosure.

An exemplary configuration for a box lid is indicated generally by the numeral 10 in the accompanying drawings. Lid 10 can be used with a shoebox-style merchandise container that is typically used for packaging shoes. Lid 10 also may be sized for use with other merchandise packages. Lid 10 is formed from a flat blank of foldable material. The foldable material can be a paper-based material or a polymer. In the exemplary configuration, the foldable material is a 0.024 Solid Bleached Sulphate (SBS) paperboard.

Lid 10 generally includes a main body panel 20, a pair of sidewalls 22, and a pair of end walls 24. Each sidewall 22 is formed from an outer sidewall panel 30 and an inner sidewall panel 32 that is connected to outer sidewall panel 30 with a living hinge or fold 34. When assembled into lid 10, panels 30 and 32 are secured together with glue to form a sidewall of double thickness. Tabs 36 project outwardly from the ends of outer sidewall panel 30. Tabs 36 are folded perpendicular to outer sidewall panel 30 when lid 10 is assembled. Tabs 30 are disposed within end walls 24. Reinforcing tabs 38 project from inner sidewall panels 32 and are folded parallel to tabs 36 and are fit within end walls 24 to strengthen the corners of lid 10. Each end wall 24 includes an outer panel 40 and an inner panel 42 that is connected to outer panel 40 with a living hinge or a fold 44. When assembled into lid 10, panels 40 and 42 are secured together with glue to form end walls of double thickness.

Figure 3:
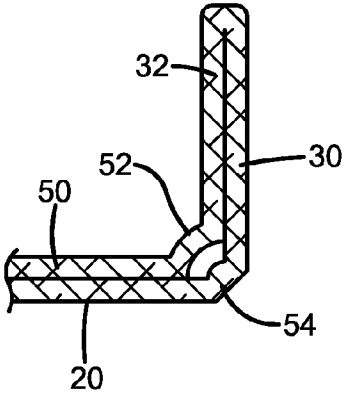
FIG. 3 is a section view taken along line 3-3 of FIG. 2.

FIG. 1 depicts the inner surfaces of the lid panels. The printing that is visible to the user looking at a closed shoe box is added to the other sides of the panels. The disclosure provides a promotional panel 50 that can be printed at the same time and during the same process as the other panels because its printing surface faces the same way and is disposed at the same level as the other panels of lid 10 prior to the assembly of lid 10. Promotional panel 50 has a length and width that are both less than main body panel 20 so that promotional panel can be folded over and glued to the interior surface of main body panel 20. Each dimension can be about one sixteenth or an eighth of an inch smaller. A plurality of integral hinges 52 connect promotional panel 50 to main body panel 20. Hinges 52 are spaced apart and are small compared to the size of panel 50. For example, in an exemplary configuration wherein promotional panel 50 is twelve inches long, each hinge can be about a quarter inch wide (the hinge's width being disposed in the same direction as the length of promotional panel in the exemplary configuration). In the areas where hinges are not located, promotional panel 50 is spaced from main body panel 20. When outer sidewall panel 30 is folded up to a perpendicular position with respect to main body panel 20, the inwardly-disposed layer of paperboard material is pushed inwardly to define a bead 54 as shown in FIG. 3. Hinges 52 span bead 54 and allow panel 50 to lay flat against panel 20. Hinges are also sized to center panel 50 on panel 20.

Figure 2:
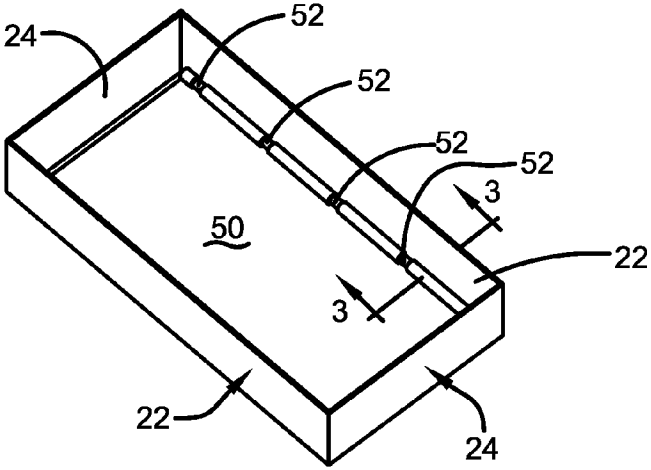
FIG. 2 is a perspective view of a lid with printing on the promotional panel.
Figure 4:
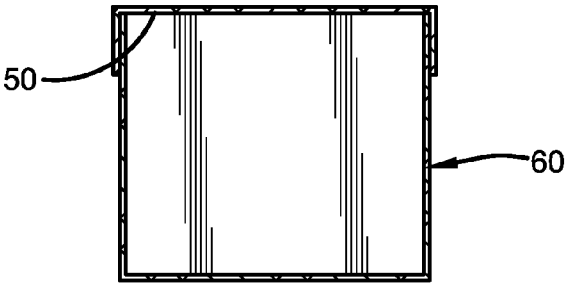
FIG. 4 is a section view of a box with the lid of the disclosure.

Panel 50 can thus be printed at the same time and with the same printing process as the other panels. When panel 50 is folded into the position depicted in FIG. 2, the printing is visible to the person who removes lid 10 from its box 60 and looks at the underside of lid 10. The printing can be a simple solid color, a pattern, artwork, a company logo, information about the product or the company, a marketing message, a coupon, instructions, or a combination of these item.

The foregoing description has been made with reference to exemplary embodiments. Modifications and alterations of those embodiments will be apparent to one who reads and understands this general description. The present disclosure should be construed as including all such modifications and alterations insofar as they come within the scope of the appended claims or equivalents thereof.

The relevant portion(s) of any specifically referenced patent and/or published patent application is/are incorporated herein by reference.

The invention claimed is:

1. A box lid, comprising:

a main body panel;

a plurality of walls extending from the main body panel; at least one of the walls having an inner panel and an outer panel;

the outer panel of the double-thickness wall defining an inwardly-projecting bead at a fold line between the outer panel and the main body panel;

the inner panel being folded back along the outer panel to define a double-thickness wall;

a promotional panel connected to the main body panel with a hinge;

the hinge directly connecting the promotional panel to the inner panel of the double-thickness wall; the hinge having a portion disposed over the inwardly-projecting bead; and the promotional panel being spaced from the inner panel.

2. The box lid of claim 1, wherein the main body panel, the plurality of walls, and the promotional panel are integrally formed from a foldable material.

3. The box lid of claim 2, wherein the foldable material is a paperboard.

4. The box lid of claim 3, wherein the paperboard is a solid bleached sulphate paperboard.

5. The box lid of claim 4, wherein the paperboard has a thickness of 0.024 inches.

6. The box lid of claim 1, wherein the main body panel has an outer surface and an inner surface and the promotional panel has an outer surface and an inner surface; the inner surface of the promotional panel being connected to the inner surface of the main body panel with an adhesive.

7. The box lid of claim 6, wherein the main body panel has a length and a width and the promotional panel has a length and a width; the length of the promotional panel being less than the length of the main body panel and the width of the promotional panel being less than the width of the main body panel.

8. The box lid of claim 1, wherein the promotional panel is centered with respect to the main body panel.

9. A foldable blank for forming a box lid, the blank comprising:

a rectangular main body panel having an inner surface and an outer surface;

a first pair of rectangular side panels located adjacent to a first pair of parallel opposed edges of the main body panel and connected to the main body panel by a first pair of fold lines;

a second pair of rectangular side panels located adjacent to a second pair of parallel opposed edges of the main body panel and connected to the main body panel by a second pair of fold lines;

the side panels having outer surfaces and inner surfaces;

each of the side panels including an outer panel and an inner panel; the outer panels being connected to the main body panel;

a promotional panel spaced from one of the inner panels with a plurality of hinges that directly connect the promotional panel to the inner panel; the hinges being spaced apart along an edge of the promotional panel to define gaps between the promotional panel and the inner panel; the promotional panel having an inner surface and an outer surface;

the outer surfaces of the panels facing the same way and being printable during a single print run; and the blank being foldable to form a box lid having a main body panel with four upstanding side walls of double thickness with the inner surface of the promotional panel connected to the inner surface of the main body panel.

10. The box lid of claim 9, wherein the main body panel has a length and a width and the promotional panel has a length and a width; the length and width of the promotional panel are smaller than the length and width of the main body panel.

11. A box lid, comprising:

a main body panel having an outer surface and an inner surface;

a lateral wall extending from the main body panel;

a promotional panel having an outer surface and an inner surface; the inner surface of the promotional panel facing the inner surface of the main body panel;

a hinge directly connecting the promotional panel to the lateral wall;

the lateral wall including an outer panel and an inner panel; the outer panel of the lateral wall defining an inwardly-projecting bead at a fold line between the outer panel and the main body panel;

the hinge having a portion disposed over the inwardly-projecting bead; and the promotional panel being spaced from the inner panel.

12. The box lid of claim 11, wherein the promotional panel is centered with respect to the main body panel.

13. The box lid of claim 11, wherein the main body panel, the lateral wall, and the promotional panel are integrally formed from a foldable material.

14. The box lid of claim 13, wherein the foldable material is a paperboard.

15. The box lid of claim 14, wherein the paperboard is a solid bleached sulphate paperboard.

16. The box lid of claim 15, wherein the paperboard has a thickness of 0.024 inches.

17. The box lid of claim 11, wherein the inner surface of the promotional panel is connected to the inner surface of the main body panel with an adhesive.

18. The box lid of claim 17, wherein the main body panel has a length and a width and the promotional panel has a length and a width; the length of the promotional panel being less than the length of the main body panel and the width of the promotional panel being less than the width of the main body panel.

19. The box lid of claim 11 wherein the lateral wall is formed from an outer wall panel and an inner wall panel that is connected to outer wall panel with a fold.

20. The box lid of claim 19, wherein the inner wall panel is adhered to the outer wall panel to form a wall of double thickness.

21. The box lid of claim 20, wherein the inner wall panel has an end with the hinge directly connected to the promotional panel extending from the end of the inner wall panel.

22. The box lid of claim 20, further comprising a tab disposed between the inner wall panel and outer wall panel.

* * * * *